US005856782A

United States Patent [19]

Sasagawa et al.

[11] Patent Number: 5,856,782

[45] Date of Patent: Jan. 5, 1999

[54] PORTABLE WIRE LOOP ANTI THEFT ALARM WITH MAGNETIC UNLOCKING

[75] Inventors: Shinichi Sasagawa; Shin Kinouchi; Seishi Namioka; Nobuyuki Ichimiya, all of Miyagi-ken; Toshitaka Toyomi, Tokyo; Hideki Arimoto, Kanagawa-ken; Hideki Miyake, Tokyo, all of Japan

[73] Assignee: Alps Electric Co., Ltd., Tokyo, Japan

[21] Appl. No.: 828,149

[22] Filed: Mar. 27, 1997

[30] Foreign Application Priority Data

Mar. 29, 1996 [JP] Japan ..... 8-077101

[51] Int. Cl.[6] ..... G08B 13/06; G08B 13/187

[52] U.S. Cl. ..... 340/572.9; 70/57.1; 340/571; 340/652

[58] Field of Search ..... 340/571, 572, 340/652; 70/57.1

[56] References Cited

U.S. PATENT DOCUMENTS 4,573,042 2/1986 Boyd et al. ..... 340/539
5,434,559 7/1995 Smiley et al. ..... 340/571

*Primary Examiner*—Glen Swann
*Attorney, Agent, or Firm*—Brinks Hofer Gilson & Lione

[57] ABSTRACT

A portable anti-theft monitor comprises a case; a detection conductive wire led out of said case, having a loop portion; an engaging member provided in said case so as to freely get it in and out, for engaging by catching the loop portion of said detection conductive wire in a state in which it has been pressed in said case; and a locking member for locking said engaging member in the state in which said engaging member has been pressed into said case, and for being attracted by a magnet to be moved in the unlocking direction.

5 Claims, 7 Drawing Sheets

PORTABLE WIRE LOOP ANTI THEFT ALARM WITH MAGNETIC UNLOCKING

BACKGROUND OF THE INVENTION

The present invention relates to a self-sounding type of portable anti-theft monitor for use with a shoplifting preventing device, etc.

In a conventional portable anti-theft monitor of this sort, for example, a self-sounding type portable anti-theft monitor (generally called "buzzer tag") which is attached to an article of merchandise, etc. to be monitored for anti-theft purpose by means of wire, etc. mounted to this portable anti-theft monitor, when the article attached with the monitor as it is passes near a gate in an attempt to illegally smuggle it out, the portable anti-theft monitor receives radio waves emitted from a sending antenna at the gate to sound a buzzer incorporated therein giving the alarm.

Further, on receipt of radio waves from the sending antenna, the portable anti-theft monitor emits radio waves with another frequency, which are received by an receiving antenna at the gate to sound also a buzzer disposed at the gate giving the alarm.

In the conventional portable anti-theft monitor, for a releasing mechanism for removing the portable anti-theft monitor from the article, there is adopted a method for mechanically unlocking by inserting a releasing jig through a hole bored in a case in which the wire is locked.

Therefore, since the releasing method for removing the portable anti-theft monitor from the article can be easily judged from outside, the portable anti-theft monitor is illegally removed from the article, and shoplifting cannot be sufficiently prevented.

SUMMARY OF THE INVENTION

It is an object of the present invention to provide a portable anti-theft monitor easy to handle which has no hole for inserting the releasing jig in appearance so that it is difficult to illegally unlock, can be unlocked without disconnecting a detection conductive wire having a loop portion and a circuit within the case by a clerk, and does not require any alarm releasing operation during unlocking.

Another object of the present invention is to provide a portable anti-theft monitor which has no hole for inserting the releasing jig in appearance, and cannot be unlocked only by bringing a magnet close, but in which it is difficult to illegally unlock, and the protruded portion of an engaging member prevents the locking member from moving in the releasing direction thereof during locking, and there is not any fear that the locking member will be released by shock due to fall, etc. or vibration.

Another object of the present invention is to provide a portable anti-theft monitor having a slide type engaging member which has smaller moving area of the engaging member during locking/unlocking thereof than a rotation type engaging member, and being capable of simply handling the engaging member and made small in size.

Another object of the present invention is to provide a portable anti-theft monitor which does not give the alarm by mistake after the locking condition is released by a clerk to sell merchandise, need not turn on/off the power supply each time in response to monitoring and monitor releasing operation, does not give any alarm by mistake even if a clerk forgets to turn off the power supply at the time of monitoring releasing operation, but is capable of restraining wasteful consumption of the battery.

In carrying out the invention and according to one aspect thereof, there is provided a portable anti-theft monitor comprising a case; detection conductive wire led out of the case and having a loop portion; an engaging member which is provided at the case so as to freely get in and out, and which is engaged by catching the loop portion of the detection conductive wire on the case in a state in which it is pressed in the case; and a locking member for locking the engaging member in a state in which it is pressed into the case and for being attracted by a magnet to be moved in the unlocking direction.

In the portable anti-theft monitor according to the above aspect of the invention, the engaging member is provided with a protruded portion which engages the locking member in a state in which it locks together the locking member to prevent the locking member from moving in the releasing direction, and during unlocking, the engaging member is once pressed in to disengage the engagement between the locking member and the protruded portion, thus enabling the locking member to move in the releasing direction thereof.

Further, the engaging member is constituted so as to get it in and out of the case by causing it to slide on a straight line.

Furthermore, there is disposed a power switch which is turned on by pressing the engaging member into the case.

DETAILED DESCRIPTION OF PREFERRED EMBODIMENT

Hereinafter, with reference to FIGS. 1 to 7, the description will be made of an embodiment according to the present invention.

Figure 1A:
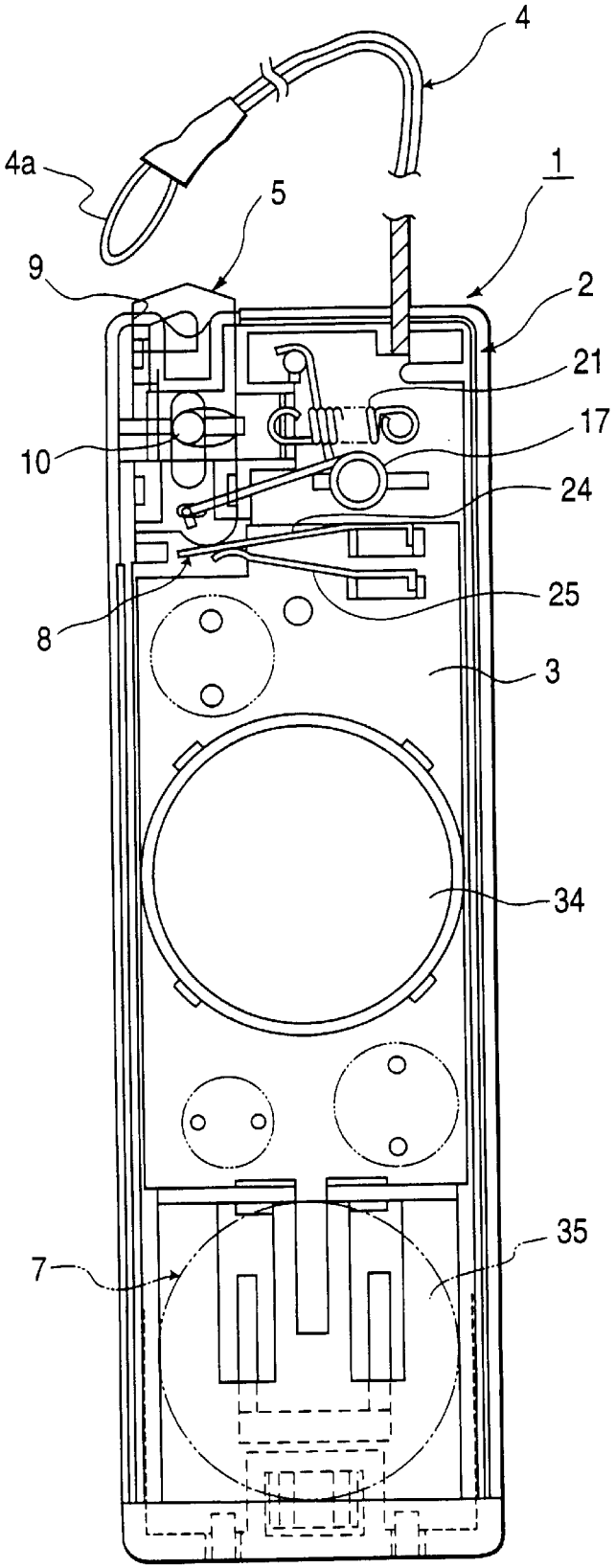
FIGS. 1A and 1B are a front view and a longitudinal sectional view showing the first embodiment with the upper case removed according to the present invention respectively.
Figure 1B:
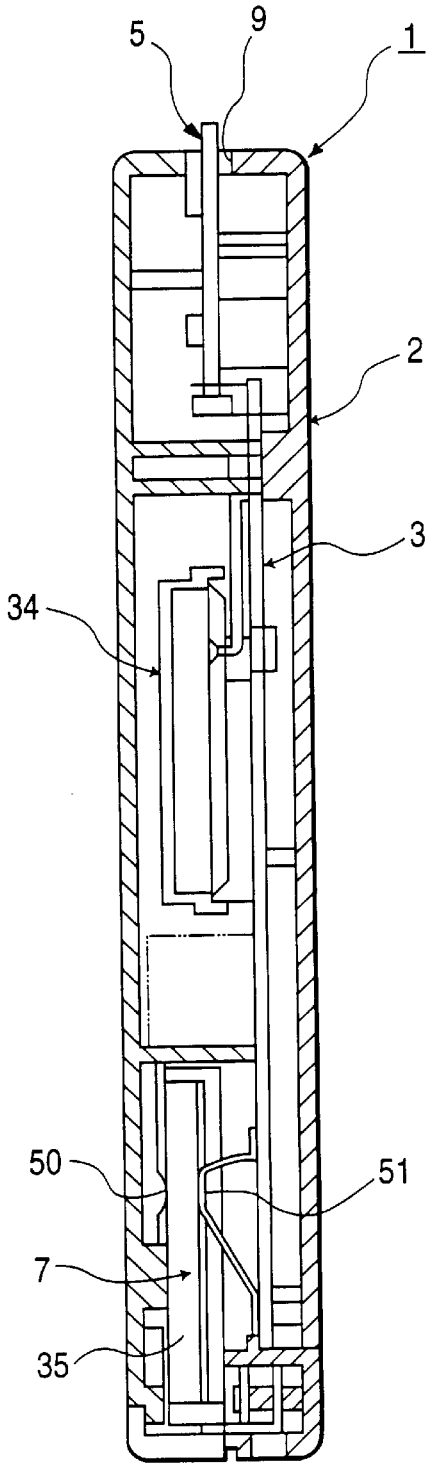
Figure 2:
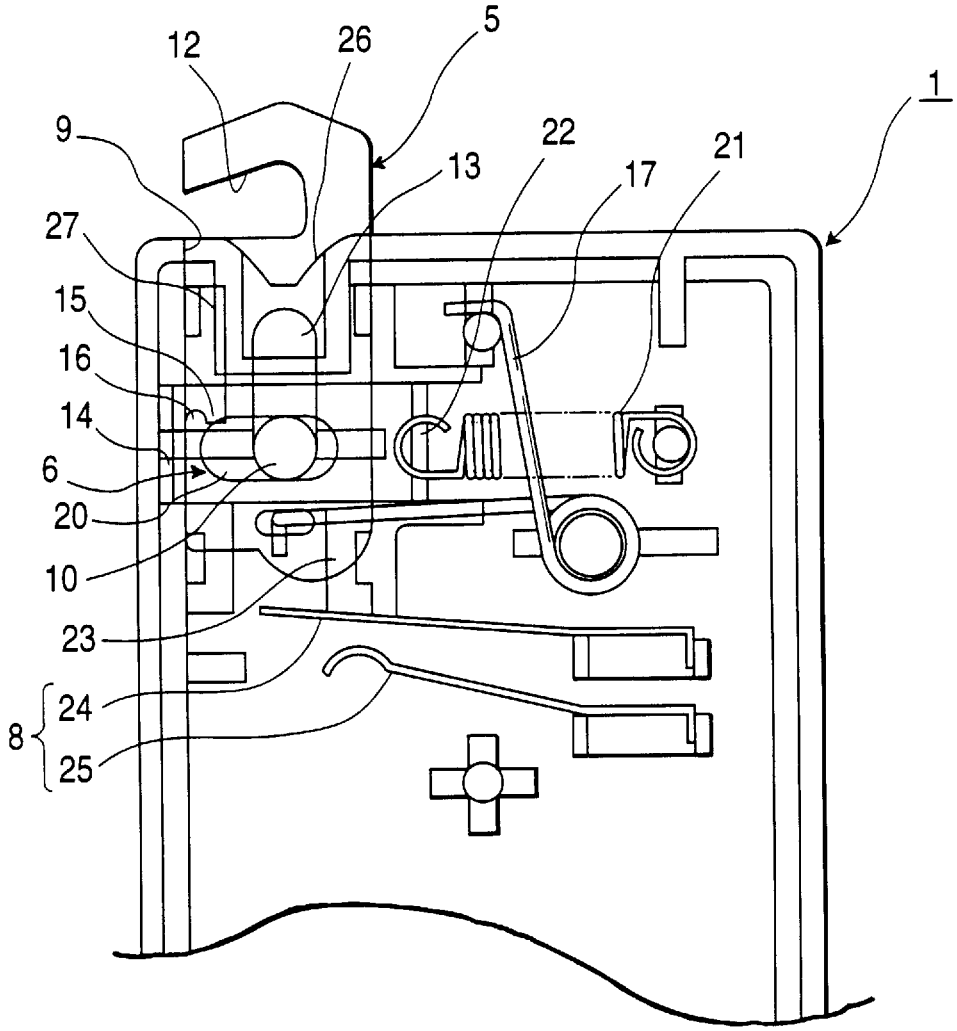
FIG. 2 is an explanatory view showing an open state in the first embodiment according to the present invention.
Figure 3:
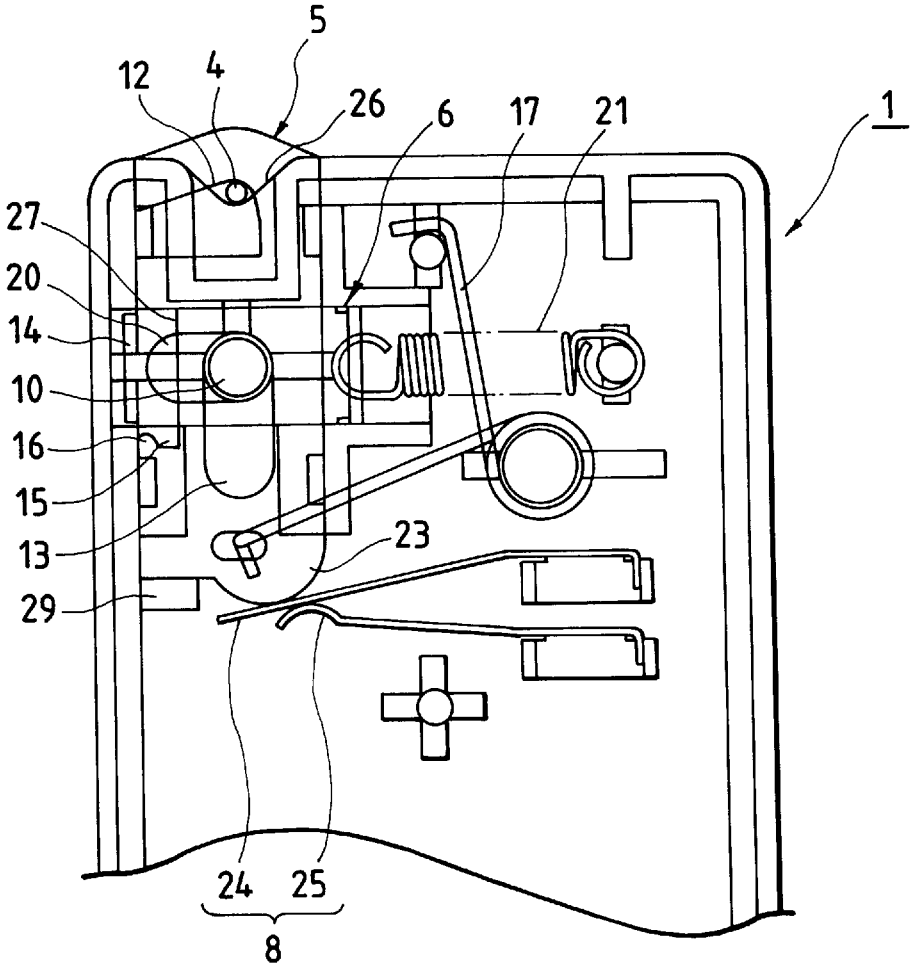
FIG. 3 is an explanatory view showing a pressed-in state in the first embodiment according to the present invention.
Figure 4:
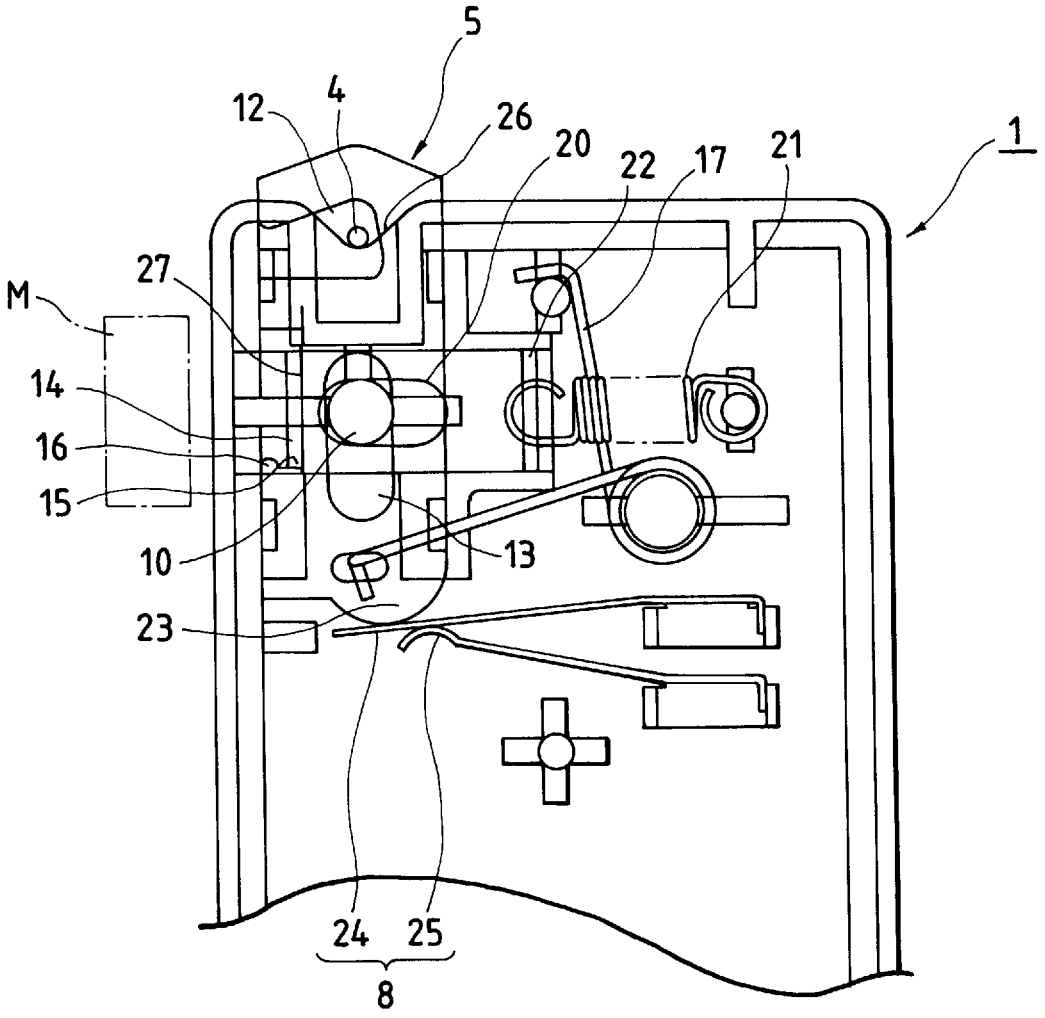
FIG. 4 is an explanatory view showing a locked state in the first embodiment according to the present invention.
Figure 5:
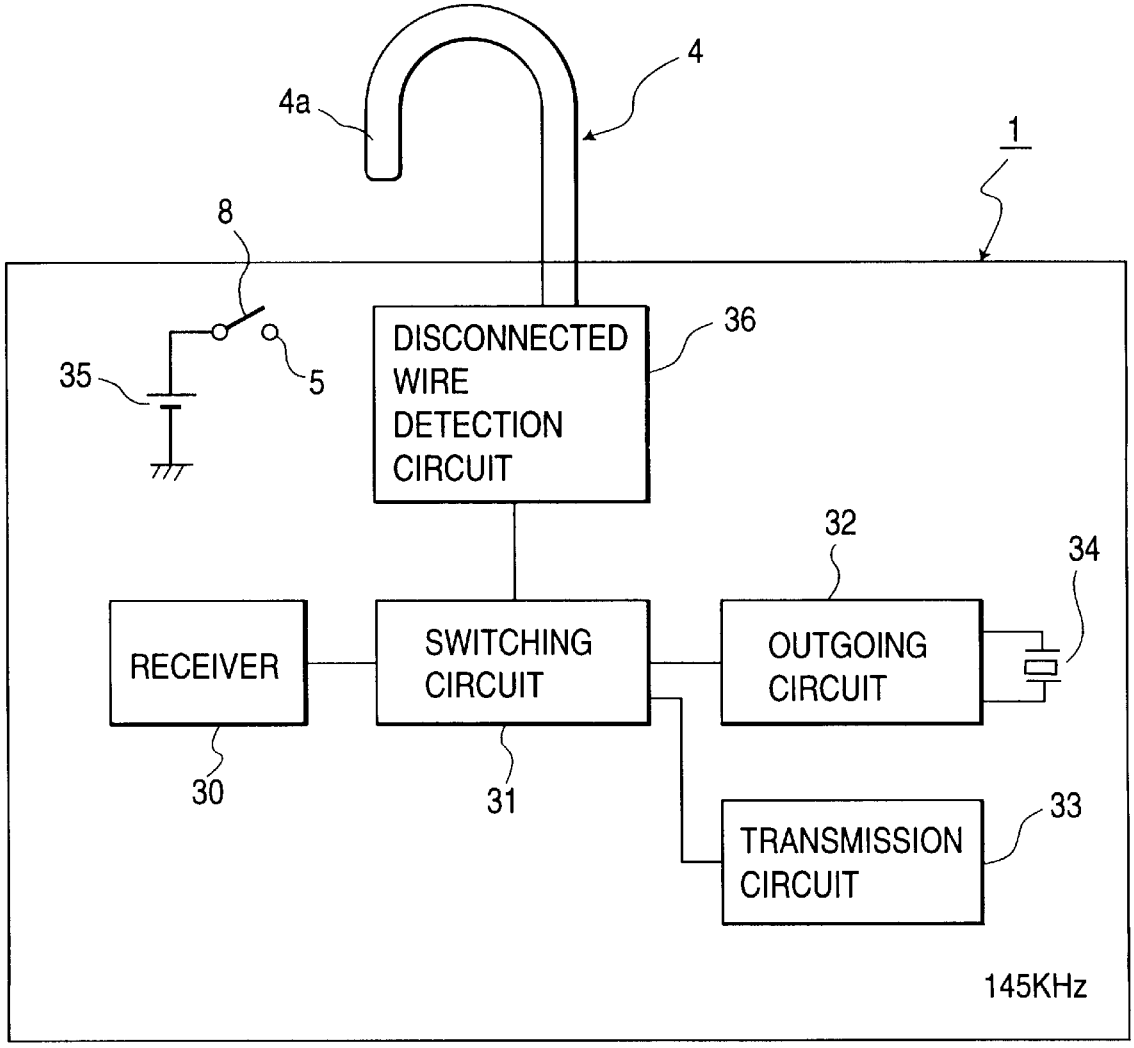
FIG. 5 is a block diagram showing a control circuit according to the first embodiment of the present invention.
Figure 6:
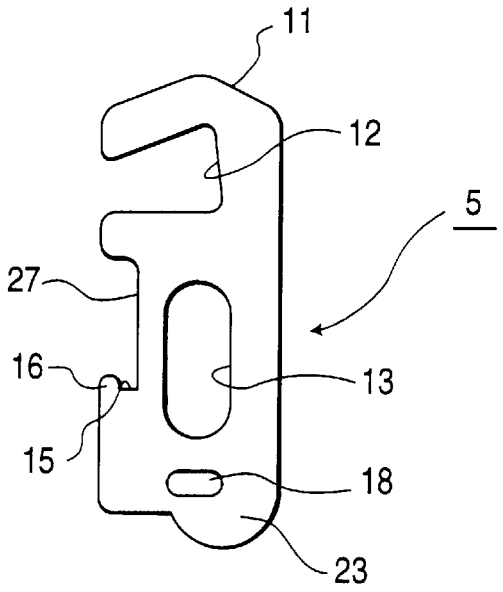
FIG. 6 is a front view showing an engaging member according to the first embodiment of the present invention.
Figure 7:
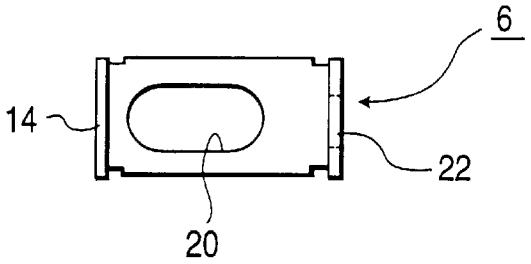
FIG. 7 is a front view showing a locking member according to the first embodiment of the present invention.
Figure 8A:
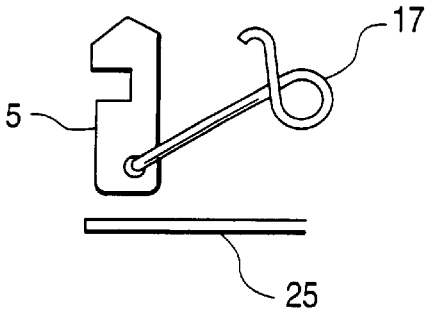
FIGS. 8A and 8B are explanatory views showing modified examples 1 and 2 of a power switch.
Figure 8B:
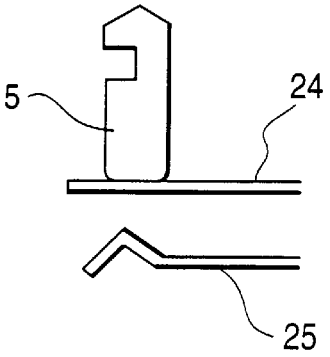

FIG. 1A is a front view showing the first embodiment with the upper case removed according to the present invention, and FIG. 1B is a longitudinal sectional view; FIG. 2 is an explanatory view showing an open state in the first embodiment; FIG. 3 is an explanatory view showing a pressed-in state in the first embodiment; FIG. 4 is an explanatory view showing a locked state in the first embodiment; FIG. 5 is a block diagram showing a control circuit according to the first embodiment; FIG. 6 is a front view showing an engaging member according to the first embodiment; FIG. 7 is a front view showing a locking member according to the first embodiment; and FIGS. 8A and 8B are explanatory views showing modified examples 1 and 2 of a power switch.

First, the description will be made of an anti-theft surveillance system in which the portable anti-theft monitor (hereinafter, referred to as buzzer tag) 1 is used.

Although not shown, a gate unit consisting of a master gate antenna and a servant gate antenna is disposed at, for example, the entrance and exit of a store, and radio waves of 32 kHz are emitted from the master gate antenna to constitute a detection area.

The buzzer tag 1 is attached to merchandise, and when the merchandise with the buzzer tag 1 on enters the detection area in an attempt to illegally smuggle it out, the receiving antenna of the buzzer tag 1 receives radio waves of 32 kHz emitted from the master gate antenna to sound the buzzer incorporated in the buzzer tag 1 giving the alarm.

Further, upon receipt of radio waves of 32 kHz, the buzzer tag 1 emits radio waves of 145 kHz. Upon receipt of these radio waves by the receiving antenna at the gate unit, the buzzer disposed at the gate unit is sounded giving the alarm. Accordingly, the buzzer sound at the gate unit can notify of theft even if the buzzer tag 1 is wrapped to reduce the buzzer sound.

Next, with reference to FIGS. 1 to 7, the description will be made of a first embodiment according to the present invention.

The buzzer tag 1 is mainly composed of a case 2 in which a upper case and a lower case are snap-engaged to make them integral with each other; a printed-circuit board 3 mounted within the case 2, with a circuit pattern and electronic parts mounted thereon; wire 4, which is detection conductive wire, connected to the circuit pattern of the printed-circuit board 3 at its both ends, and led out of the case 2 in a loop shape; an engaging member (hook member) 5 for engaging by catching the loop portion 4*a* of the wire 4; a locking member 6 which locks in a pressed-in state when the engaging member 5 catches the loop portion 4*a* of the wire 4 to be pressed into the case 2; a buzzer 34 for giving alarm sound; a battery box 7 for housing a battery for power supply; and a power switch 8 for turning on and off the connection between the battery in the battery box 7 and the circuit of the printed-circuit board 3.

The engaging member 5 is made of plate material, and is slidably supported by a guide groove in the case 2 and a guide pin 10 so as to protrude from an opening 9 in the upper surface of the case 2. This engaging member 5 is, as shown in FIGS. 2 and 6, provided with an upside portion 11 formed in a mountain shape; a notch engaging portion 12 obtained by deep cutting the side of the upper portion toward the interior thereof for engaging the loop portion 4*a* of the wire 4; a long hole portion 13 formed in the slide direction in which a guide pin 10 is inserted; a concave portion 27 which is formed by cutting the side portion and the lock piece 14 of the locking member 6 enters; a lock stepped portion 15 formed in the interior of the lower edge of the concave portion 27, with which the lock piece 14 of the locking member 6 to be described later is engaged when it locks the locking member 6; a protruded portion 16 formed on this side of the lower edge of the concave portion 27, for engaging the locking member 6 in a locked state to prevent it from moving in the unlocking direction; a hole 18 with which there is engaged one end of a torsion coil spring 17 for biasing the engaging member 5 toward within the case; and a contact piece operating portion 23 whose lower end is formed in a circular arc shape, for turning on or off by abutting against the contact piece of the power switch 8.

In the torsion coil spring 17, the coil portion thereof is inserted in the pin in the case 2, and one end of the spring is engaged with the hole 18 in the engaging member 5 as described above while the other end thereof is engaged with the supporting portion of the case 2. The spring force of the torsion coil spring 17 exerts through the hole 18 so as to bias the engaging member 5 upwardly in FIG. 2.

The locking member 6 is made of plate material, and is guided by the guide groove in the case 2, the guide pin 10 and the like so as to freely slide in the direction perpendicular to the slide direction of the engaging member 5. This locking member 6 is, as shown in FIGS. 2 and 7, provided with a long hole portion 20 into which a guide pin 10 is inserted, formed along the slide direction; a catching portion 22 with which one end of a tensile coil spring 21 for biasing the locking member 6 toward within the case 2 is engaged; and a locking piece 14 formed by bending it at substantially right angles, for engaging the lock stepped portion 15 and the protruded portion 16 of the engaging member 5.

The tensile coil spring 21 is, at its one end, hooked on the catching portion 22 of the locking member 6 and is, at the other end, hooked on the pin portion in the case 2. The spring force of the tensile coil spring 21 biases the locking member 6 in the right direction (locking direction) in FIG. 2.

The lock piece 14 of the locking member 6 is disposed substantially in parallel to the side of the case 2 so that it is kept apart from or close to the side of the case 2 by the slide of the locking member 6. By bringing a magnet M close to the side of the case 2 (FIG. 4) near the lock piece 14 of the locking member 6, the lock piece 14, that is, the locking member 6 is attracted in the left direction in FIG. 2 against the spring force of tensile coil spring 21. In this respect, in the side portion of the case 2 to which the lock piece 14 of the locking member 6 faces, a concave portion of thin wall thickness is formed so that the magnetic force of the magnet M effectively exerts on the lock piece 14 of the locking member 6.

The power switch 8 consists of an upper contact piece 24 and a lower contact piece 25 which are, at their one ends, fixed to the printed-circuit board 3, and connected to the circuit pattern at their other ends respectively. By means of the contact piece operating portion 23 of the engaging member 5 which has slid downward, the other end of the upper contact piece 24 is pressed downward and comes into contact with the lower contact piece 25 to turn on. On the other hand, when the engaging member 5 slides upward, the upper contact piece 24 is separated from the lower contact piece 25 to turn off.

On the upper surface of the case 2 corresponding to the notch engaging portion 12 of the engaging member 5 which catches the loop portion 4*a* of the wire 4, a substantially V-shaped groove 26 is formed as shown in FIG. 2. Thereby, in a state in which the loop portion 4*a* of the wire 4 is engaged with the notch engaging portion 12 by pressing the engaging member 5 into the case 2, the upper portion of the engaging member 5 is seemingly embedded into the case 2 as shown in FIG. 4 so that the upper portion of the notch engaging portion 12 of the engaging member 5 is pressed to such a degree that it is slightly exposed on the V-letter shaped groove 26. Accordingly, since the upper portion of the engaging member 5 is hard to cut, it is difficult to remove the wire 4 from the notch engaging portion 12.

In the battery box 7, connecting terminals 50 and 51 are mounted to the lower case so that they contact the two sides of a battery so as to sandwich it between them. This connecting terminal 50 is arranged to be bent within the concave portion in the inner surface of the upper case when the battery is housed in the battery box 7.

Next, the description will be made of the operation in the first embodiment.

FIG. 2 shows an open state (state in which the wire is not attached to merchandise) of the engaging member 5. In this open state, the engaging member 5 is biased upwardly by the torsion coil spring 17 to protrude the upper portion thereof from the opening 9 in the upper surface of the case 2. The notch engaging portion 12 of the engaging member 5 is positioned above the upper surface of the case 2, and the wire 4 is disengaged from the notch engaging portion 12 of the engaging member 5.

The contact piece operating portion 23 of the engaging member 5 is apart above from the upper contact piece 24 of the power switch 8, which is apart from the lower contact piece 25 to be in the off state.

In this respect, by means of an unlocking operation to be described later, the locking member 6 is attracted in the left direction in FIG. 2 against the spring force of the tensile coil spring 21 by a strong magnet M to bring the lock piece 14 into tight contact with the inner wall of the side of the case 2. Thereby, the locking member 6 is unlocked to raise the engaging member 5, and the lock piece 14 of the locking member 6 is urged against the side edge portion of the engaging member 5 by means of the spring force of the tensile coil spring 21.

In the state of FIG. 2, after passing the wire 4 through a hole or the like in the merchandise, the loop portion 4*a* of the wire 4 is allowed to pass through the notch engaging portion 12 of the engaging member 5.

Then, the engaging member 5 is pressed in downward in FIG. 2 against the spring force of the torsion coil spring 17. The engaging member 5 is slid downward, and the loop portion 4*a* of the wire 4 within the notch engaging portion 12 is moved into the interior of the notch engaging portion 12 because of the upper edge thereof being inclined (the entrance and exit of the notch engaging portion 12 are narrow). Therefore, it is difficult for the loop portion 4*a* of the wire 4 to be disengaged from the notch engaging portion 12 while the engaging member 5 is moving downward, and the engagement can be ensured.

The downward movement of the engaging member 5 causes the contact piece operating portion 23 thereof to abut against the upper contact piece 24 of the power switch 8 to press it down, and the upper contact piece 24 is caused to come into contact with the lower contact piece 25 as shown in FIG. 3 to turn on.

FIG. 3 shows a state in which the engaging member 5 has been pressed in most deeply, and immediately before the locking member 6 slides in the right direction. That is, when the engaging member 5 is pressed in and slides until the lock piece 14 of the locking member 6 is positioned above the protruded portion 16 of the engaging member 5, the entire lock piece 14 of the locking member 6 enters a state in which it can fall in the concave portion 27 of the engaging member 5.

In the state of FIG. 3, while the entire lock piece 14 of the locking member 6 is falling into the concave portion 27 of the engaging member 5 by means of the spring force of the tensile coil spring 21, the locking member 6 slides in the right direction (locking direction) in FIG. 3. As shown in FIG. 4, the lower edge of the lock piece 14 of the locking member 6 rides over the protruded portion 16, and the right surface of the lock piece 14 knocks against the back edge of the concave portion 27. Thus, when the pressing-in of the engaging member 5 is stopped, the engaging member 5 moves upward by the spring force of the torsion coil spring 17, but the lock stepped portion 15 of the engaging member 5 knocks against the lower end edge of the lock piece 14 of the locking member 6 as shown in FIG. 4, and the engaging member 5 is locked to maintain the pressed-in position.

In the state of FIG. 4, the loop portion 4*a* of the wire 4 is locked within the hole constituted by the notch engaging portion 12 of the engaging member 5 and the V-shaped groove 26 in the case 2.

Next, the description will be made of the control circuit of this first embodiment.

In FIG. 5, numeral 1 designates a buzzer tag; 4, wire; 8, a power switch; 30, a receiver; 31, a switching circuit connected to the receiver 30; 32, an outgoing circuit; 33, a transmission circuit; 34, a buzzer driven by the outgoing circuit 32; 35, a battery housed in the battery box 7; and 36, a disconnected wire detection circuit connected to both ends of the loop-shaped wire 4. The power switch 8, receiver 30, switching circuit 31, outgoing circuit 32, transmission circuit 33, buzzer 34 and disconnected wire detection circuit 36 are provided on the printed-circuit board.

On receipt of radio waves of 32 kHz from the master gate antenna by the receiver 30, the switching circuit 31 operates the outgoing circuit 32 to sound the buzzer 34 giving the alarm. Also, the switching circuit 31 operates the transmission circuit 33 to transmit radio waves of 145 kHz as described above.

Also when the wire 4 is cut in order to illegally remove the merchandise from the buzzer tag 1, the disconnected wire detection circuit 36 connected to the wire 4 detects this to transmit a signal to the switching circuit 31, which operates the outgoing circuit 32 to sound the buzzer 34 giving the alarm, and operates the transmission circuit 33 to transmit radio waves of 145 kHz as described above.

Next, the description will be made of an operation of removing the buzzer tag 1 from the merchandise.

In the non-open state of the engaging member 5 shown in FIG. 4, when a magnet M (indicated by one dotted chain line) having a powerful magnetic force is brought close to the side of the case 2, a force for moving in the left direction in FIG. 2 exerts on the locking member 6 which is pulled toward the right side in FIG. 4 by means of the spring force of the tensile coil spring 21. In the state of FIG. 4, however, the protruded portion 16 prevents the locking member 6 from moving in the releasing direction of the locking member 6, and the locking condition cannot be released.

In the case of the first embodiment, when the upper end of the engaging member 5 in the state of FIG. 4 is pressed downward up to a stopper 29 as shown in FIG. 3, the protruded portion 16 of the engaging member 5 also lowers to allow the locking member 6 to slide toward the left side (releasing direction) in FIG. 4.

In this state, when the magnet M is brought close to the side of the case 2 as described above, the locking member 6 slides in the left direction (releasing direction) in FIG. 4 against the spring force of the tensile coil spring 21, and the state becomes as shown in FIG. 3. Then, the lock piece 14 of the locking member 6 disengaged from the concave portion 27 of the engaging member 5 to release the locking condition thereof, and the engaging member 5 is slid upward by the spring force of the torsion coil spring 17. As shown in FIG. 2, the notch engaging portion 12 of the engaging member 5 rises up to the upper surface of the case 2 to be opened. In this state, it becomes easy for the wire 4 to come out of the notch engaging portion 12 by making the wire 4 elastic (for example, made of stainless steel) and combined with the shape of the notch engaging portion 12.

Then when the magnet M is removed, the locking member 6 is biased in the locking direction by the spring force of the tensile coil spring 21 so that the lock piece 14 of the locking member 6 is urged against the side edge portion of the engaging member 5 as shown in FIG. 2. In this respect, as the engaging member 5 rises from the state of FIG. 3 to that of FIG. 2, the upper contact piece 24 which has been pressed down by the contact piece operating portion 23 of the engaging member 5 and in contact with the lower contact piece 25, rises by its own elastic returning force, and is separated from the lower contact piece 25 to be in the off-state.

Thus, the buzzer tag 1 can be removed from the merchandise by removing the loop portion 4*a* of the wire 4 from the notch engaging portion 12 of the engaging member 5 and further removing the wire 4 from the merchandise.

Next, the description will be made of an operation in which when the wire 4 has been attached to the merchandise in the non-open state in FIG. 4, an attempt to remove the buzzer tag 1 from the merchandise by cutting the wire 4 is made.

When the wire 4 is cut in order to illegally remove the merchandise from the buzzer tag 1, the disconnected wire detection circuit 36 connected to the wire 4 shown in FIG. 5 detects this cutting to transmit a signal to the switching circuit 31, which operates the outgoing circuit 32 to sound the buzzer 34 giving the alarm, and at the same time, operates the transmission circuit 33 to transmit radio waves of 145 kHz as described above. The gate unit which has received these radio waves also emits the alarm. This operation is also performed beyond the aforesaid detection area.

The power switch 8 may be constituted as shown in modified examples 1 and 2 in FIGS. 8A and 8B.

In this modified example 1, the aforesaid upper contact piece 24 is not provided as shown in FIG. 8A, but the engaging member 5 is used also as the upper contact piece.

Also, in the modified example 2, as shown in FIG. 8B, the aforesaid torsion coil spring 17 is not provided, but the engaging member 5 is biased upward by taking advantage of the elastic force of the upper contact piece 24.

In each of such aforesaid first embodiment, since design has been made such that the engaging member 5 is put in and taken out of the case 2 by sliding it on a straight line, the engaging member 5 of the slide type has smaller moving area during locking/unlocking than that of a rotation type. Therefore, it is possible to handle the engaging member 5 simply and to miniaturize it.

The description will be made of the second embodiment according to the present invention.

Figure 9:
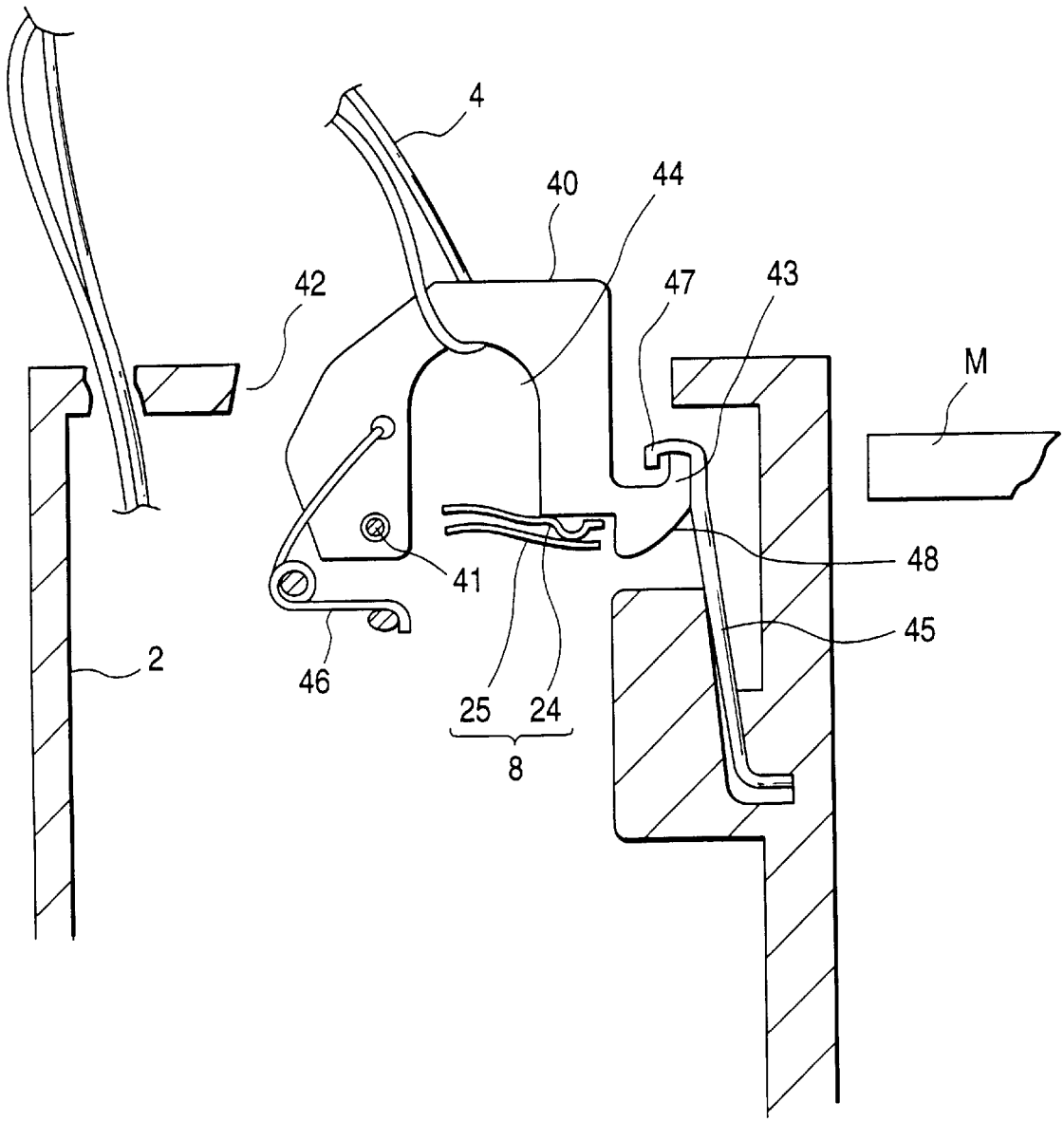
FIG. 9 is an explanatory view showing a locked state according to the second embodiment of the present invention.

FIG. 9 is an explanatory view showing the locked state of the second embodiment according to the present invention. Although the aforesaid first embodiment uses the slide type in which the engaging member enters and leaves the case by sliding on a straight line, the second embodiment uses a rotation type engaging member.

That is, as shown in FIG. 9, the engaging member 40 is constructed in such a manner that one end thereof is rotatably supported on the case 2 by a supporting shaft 41 and the other end of the engaging member 40 can be taken in and out of the opening 42 in the upper surface of the case 2.

The engaging member 40 is biased in counterclockwise direction (open direction) around the supporting shaft 41 by a torsion coil spring 46.

This engaging member 40 is formed in a substantially U-shape, at one end portion of which the supporting shaft 41 is inserted, at the other end portion of which an engaging portion 43 is provided, and the central lower end of which is cut to form a notch engaging portion 44. The wire 4 is engaged within the notch engaging portion 44 in the same manner as in the first embodiment. Also at the lower portion of the tip end of the engaging member 40, there is formed an inclined portion 48 which abuts against the pawl 47 of an engaging leaf spring 45 during pressing-in operation of the engaging member 40 for guiding.

The engaging member 40 is, as shown in FIG. 9, locked against the torsion coil spring 46 by the engaging portion 43 being engaged with an engaging leaf spring 45, which is a locking member held by the case 2 when pressed in.

This engaging leaf spring 45 is constructed in such a manner that the lower end thereof is embedded in the case 2, and the upper end portion is elastically deformable in the lateral direction in FIG. 9. At the tip end of the engaging leaf spring 45, there is formed a pawl 47, which is an protruded portion bent into a U-shape in its cross section, and since this pawl 47 is inserted into the concave portion in the engaging portion 43, on releasing the locking condition, the upper end portion of the engaging leaf spring 45 cannot be elastically deformed in the right direction in FIG. 9 unless the engaging member 40 is once pressed in.

In this respect, there are disposed an upper contact piece 24 and a lower contact piece 25 of a power switch 8 so that the upper contact piece 24 is pressed down by the lower surface of the tip end portion of the engaging member 40 to bring it into contact with the lower contact piece 25 to turn on in the state of FIG. 9.

When the locking condition is released and the engaging member 40 rotates in counterclockwise direction, the upper contact piece 24 also returns upward with a rise of the tip end portion of the engaging member 40, and is separated from the lower contact piece 25 to turn off.

Next, the description will be made of the operation of the aforesaid second embodiment.

The state of FIG. 9 is a locked state corresponding to FIG. 4 of the first embodiment, and on releasing,the locking condition from the state of FIG. 9, the engaging member 40 is first pressed in and the tip end of the engaging leaf spring 45 is caused to be in a condition in which it can come out of the engaging portion 43 of the engaging member 40, and the magnet M is brought close to the side of the case 2. Then the magnetic force of the magnet M attracts the tip end of the engaging leaf spring 45 in the right direction in FIG. 9 for unlocking.

Next, when the pressing down of the engaging member 40 is stopped, the torsion coil spring 46 rotates the engaging member 40 around the supporting shaft 41 in counterclockwise direction (open direction) to open the notch engaging portion 44 above the upper surface of the case 2, and the wire can be removed in the same manner as in the first embodiment.

In this respect, when the magnet M is removed thereafter, the engaging leaf spring 45 elastically returns to the original condition, and returns to the state of FIG. 9.

A case where the wire 4 is engaged with the engaging member 40 will be described.

The wire 4 is put in the notch engaging portion 44 and the engaging member 40 is pressed in against the torsion coil spring 46. Then, the upper end of the engaging leaf spring 45 abuts against the inclined portion 48 of the engaging member 40 and slides on the outer surface of the engaging member 40 while it is being elastically deformed in the right direction in FIG. 9. Thus, the pawl 47 of the engaging leaf spring 45 is engaged with the engaging portion 43 of the engaging member 40 as shown in FIG. 9 to lock the engaging member 40. In this state, the power switch 8 has been turned on as described above.

The other structure and operation which have not been particularly described are the same as in the first embodiment.

In each of the aforesaid embodiments, there are provided a case 2; wire 4 led out of the case 2 and having a loop portion 4*a*; engaging members 5 and 40 which are provided in the case 2 so as to freely get in and out, and which are engaged by catching the loop portion 4*a* of the wire 4 in a state in which they have been pressed in the case 2; and locking members 6 and 45 for locking the engaging members 5 and 40 in a state in which they are pressed into the case 2 and for being attracted by a magnet M to be moved in the unlocking direction. In addition, there is no hole into which a releasing jig is inserted in appearance, and therefore, it is difficult to illegally release the locking condition. Since the wire 4 having the loop portion 4*a* and the circuit within the case 2 are not disconnected even if the locking condition is released, the alarm releasing operation does not have to be performed during unlocking, and it is simple to handle.

In each of the aforesaid embodiments, the engaging member 5, 40 is provided with a protruded portion 16 (pawl 47) for preventing the locking member 6 (engaging leaf spring 45) from moving in the releasing direction thereof by engaging the locking member 6 (engaging leaf spring 45) in a locked state with the locking member 6 (engaging leaf spring 45). During unlocking, the engaging member 5, 40 is once pressed in and it has been made possible to move the locking member 6 (engaging leaf spring 45) in the releasing direction by disengaging the engagement between the locking member 6 (engaging leaf spring 45) and the protruded portion 16 (pawl 47). Therefore, the locking condition cannot be released only by bringing the magnet M close and it is difficult to illegally unlock. During locking, the protruded portion 16 (pawl 47) of the engaging member 5, 40 prevents the locking member 6 (engaging leaf spring 45) from moving in the releasing direction. Therefore, there is not any fear that the locking member 6 (engaging leaf spring 45) will be released by shock due to fall, etc. or vibration.

In each of the aforesaid embodiments, since there has been disposed a power switch 8 which is turned on by pressing the engaging member 5, 40 into the case 2, the power supply is always off when the engaging member 5, 40 is not locked, namely when not in use. Therefore, no alarm is given by mistake after unlocked by a clerk to sell merchandise. It is not necessary to turn on/off the power supply each time in response to monitoring and monitor releasing operation, and no alarm is given by mistake even if you forget to turn off the power supply at the time of the monitor releasing operation. In addition, wasteful consumption of the battery can be restricted.

Many widely different embodiments of the invention may be constructed without departing from the spirit and scope of the present invention. It should be understood that the present invention is not limited to the specific embodiments described in the specification, except as defined in the appended claims.

What is claimed is:

1. A portable anti-theft monitor comprising:

a case;

a detection conductive wire led out of said case, having a loop portion;

an engaging member provided in said case so as to freely move in and out, for engaging by catching said loop portion of said detection conductive wire in a state in which it has been pressed into said case; and a locking member for locking said engaging member in the state in which said engaging member has been pressed into said case, and for being attracted by a magnet to be moved in the unlocking direction.

2. A portable anti-theft monitor as defined in claim 1 wherein said engaging member is provided with a protruding portion for engaging said locking member in a locked state with said locking member to prevent said locking member from moving in the unlocking direction thereof, and, to release said locking member from protruding portion, said engaging member is first pressed in to allow said locking member to move in the unlocking direction thereof by releasing the engagement between said locking member and said protruding portion.

3. A portable anti-theft monitor as defined in claim 2, wherein said engaging member moves in and out of said case by sliding on a straight line.

4. A portable anti-theft monitor as defined in claim 1, wherein said engaging member is taken in and out of said case by sliding on a straight line.

5. A portable anti-theft monitor as defined in claim 1, wherein a power switch is disposed to be turned on by pressing said engaging member into said case.

* * * * *

UNITED STATES PATENT AND TRADEMARK OFFICE

CERTIFICATE OF CORRECTION

PATENT NO. : 5,856,782

DATED : January 5, 1999

INVENTOR(S) : Sasagawa et al.

It is certified that error appears in the above-identified patent and that said Letters Patent is hereby corrected as shown below:

In the Title Page, item [54], and

In column 1, line 1, replace "ANTI THEFT" with --ANTI-THEFT--.

In column 2, after line 1, under "U.S. PATENT DOCUMENTS" add a new line as follows:

--5,191,314 3/1993 Ackerman et al. 340/571--.

In column 2, after line 2, under "U.S. PATENT DOCUMENTS" add a new line as follows:

--5,610,587 3/1997 Fujiuchi et al. 340/571--.

Signed and Sealed this

Sixth Day of July, 1999

*Attest:*

Q. TODD DICKINSON

*Attesting Officer*

*Acting Commissioner of Patents and Trademarks*